US006145852A

United States Patent [19]

Bain

[11] Patent Number: 6,145,852

[45] Date of Patent: Nov. 14, 2000

[54] INLINE SKATE ASSEMBLY

[76] Inventor: Thomas A. Bain, 230 Auburn Avenue, Hamilton, Ontario, Canada, LSK 3B6

[21] Appl. No.: 09/097,964

[22] Filed: Jun. 16, 1998

[51] Int. Cl.[7] ..... A63C 17/02

[52] U.S. Cl. ..... 280/11.22; 280/11.27

[58] Field of Search ..... 280/11.19, 11.22, 280/11.23, 11.26, 11.27, 11.28, 11.3, 11.31, 11.32, 11.33; 36/115

[56] References Cited

U.S. PATENT DOCUMENTS

| | | | |
|---|---|---|---|
| 4,008,901 | 2/1977 | Conn | 280/11.3 |
| 4,928,982 | 5/1990 | Logan | 280/11.31 |
| 4,988,122 | 1/1991 | Saunders | 280/11.19 X |
| 5,193,827 | 3/1993 | Olson | 280/11.3 X |
| 5,411,278 | 5/1995 | Wittman | 280/11.22 |
| 5,507,506 | 4/1996 | Shadroui | 280/11.22 |
| 5,934,693 | 8/1999 | Nicoletti | 280/11.22 |

*Primary Examiner*—Brian L. Johnson
*Assistant Examiner*—Bryan Fischmann

[57] ABSTRACT

A new inline skate assembly for permitting detachment of the truck or blade portion from the boot portion. The inventive device includes a boot portion and a truck portion. The boot portion has a sole, and heel and toe ends. The truck portion has a top, first and second ends, a pair of sides, and a plurality of ground engaging wheels rotatably mounted thereto. The sole of the boot portion has an elongate channel therein. The length of the channel is extended between the heel and toe ends of the boot portion. The top of the truck portion is slidably insertable into the channel of the sole of the boot portion to attach the truck portion to the base portion.

10 Claims, 3 Drawing Sheets

FIG. 1
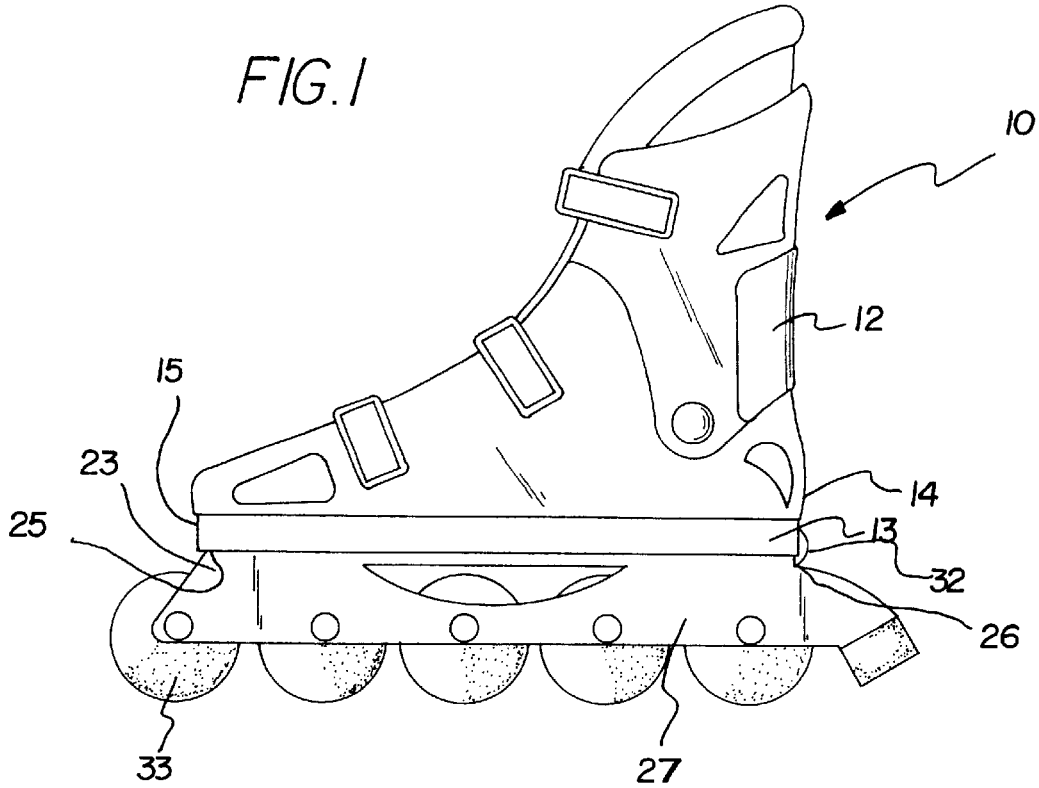
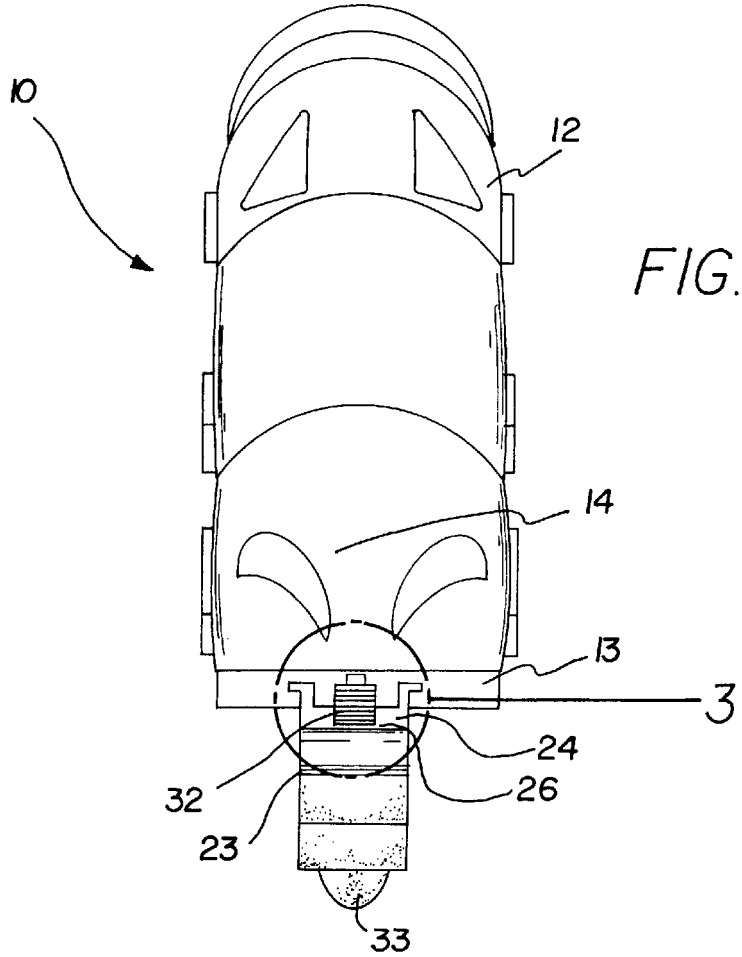
FIG. 2

INLINE SKATE ASSEMBLY

BACKGROUND OF THE INVENTION

1. Field of the Invention

The present invention relates to inline skates and more particularly pertains to a new inline skate assembly for permitting detachment of the truck or blade portion from the boot portion.

2. Description of the Prior Art

The use of inline skates is known in the prior art. More specifically, inline skates heretofore devised and utilized are known to consist basically of familiar, expected and obvious structural configurations, notwithstanding the myriad of designs encompassed by the crowded prior art which have been developed for the fulfillment of countless objectives and requirements.

Known prior art inline skates include U.S. Pat. No. 5,595,392; U.S. Pat. No. 5,193,827; U.S. Pat. No. 2,181,779; U.S. Pat. No. 4,932,675; U.S. Pat. No. Des. 335,576; and U.S. Pat. No. 3,292,940.

While these devices fulfill their respective, particular objectives and requirements, the aforementioned patents do not disclose a new inline skate assembly. The inventive device includes a boot portion and a truck portion. The boot portion has a sole, and heel and toe ends. The truck portion has a top, first and second ends, a pair of sides, and a plurality of ground engaging wheels rotatably mounted thereto. The sole of the boot portion has an elongate channel therein. The length of the channel is extended between the heel and toe ends of the boot portion. The top of the truck portion is slidably insertable into the channel of the sole of the boot portion to attach the truck portion to the base portion.

In these respects, the inline skate assembly according to the present invention substantially departs from the conventional concepts and designs of the prior art, and in so doing provides an apparatus primarily developed for the purpose of permitting detachment of the truck or blade portion from the boot portion.

SUMMARY OF THE INVENTION

In view of the foregoing disadvantages inherent in the known types of inline skates now present in the prior art, the present invention provides a new inline skate assembly construction wherein the same can be utilized for permitting detachment of the truck or blade portion from the boot portion.

The general purpose of the present invention, which will be described subsequently in greater detail, is to provide a new inline skate assembly apparatus and method which has many of the advantages of the inline skates mentioned heretofore and many novel features that result in a new inline skate assembly which is not anticipated, rendered obvious, suggested, or even implied by any of the prior art inline skates, either alone or in any combination thereof.

To attain this, the present invention generally comprises a boot portion and a truck portion. The boot portion has a sole, and heel and toe ends. The truck portion has a top, first and second ends, a pair of sides, and a plurality of ground engaging wheels rotatably mounted thereto. The sole of the boot portion has an elongate channel therein. The length of the channel is extended between the heel and toe ends of the boot portion. The top of the truck portion is slidably insertable into the channel of the sole of the boot portion to attach the truck portion to the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inline skate assembly apparatus and method which has many of the advantages of the inline skates mentioned heretofore and many novel features that result in a new inline skate assembly which is not anticipated, rendered obvious, suggested, or even implied by any of the prior art inline skates, either alone or in any combination thereof.

It is another object of the present invention to provide a new inline skate assembly which may be easily and efficiently manufactured and marketed.

It is a further object of the present invention to provide a new inline skate assembly which is of a durable and reliable construction.

An even further object of the present invention is to provide a new inline skate assembly which is susceptible of a low cost of manufacture with regard to both materials and labor, and which accordingly is then susceptible of low prices of sale to the consuming public, thereby making such inline skate assembly economically available to the buying public.

Still yet another object of the present invention is to provide a new inline skate assembly which provides in the apparatuses and methods of the prior art some of the advantages thereof, while simultaneously overcoming some of the disadvantages normally associated therewith.

Still another object of the present invention is to provide a new inline skate assembly for permitting detachment of the truck or blade portion from the boot portion.

Yet another object of the present invention is to provide a new inline skate assembly which includes a boot portion and a truck portion. The boot portion has a sole, and heel and toe ends. The truck portion has a top, first and second ends, a pair of sides, and a plurality of ground engaging wheels rotatably mounted thereto. The sole of the boot portion has an elongate channel therein. The length of the channel is extended between the heel and toe ends of the boot portion. The top of the truck portion is slidably insertable into the channel of the sole of the boot portion to attach the truck portion to the base portion.

Still yet another object of the present invention is to provide a new inline skate assembly that permits a wearer to slidably detach the truck or blade portion from the boot portion so that the wearer may walk on a ground surface with the sole of the boot portion of the inline skate assembly.

Even still another object of the present invention is to provide a new inline skate assembly that allows wearers to wear inline skates into establishments that do not allow inline skates to be worn therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new inline skate assembly according to the present invention.

FIG. 2 is a schematic heel end view of the present invention.

DESCRIPTION OF THE PREFERRED EMBODIMENT

Figure 3:
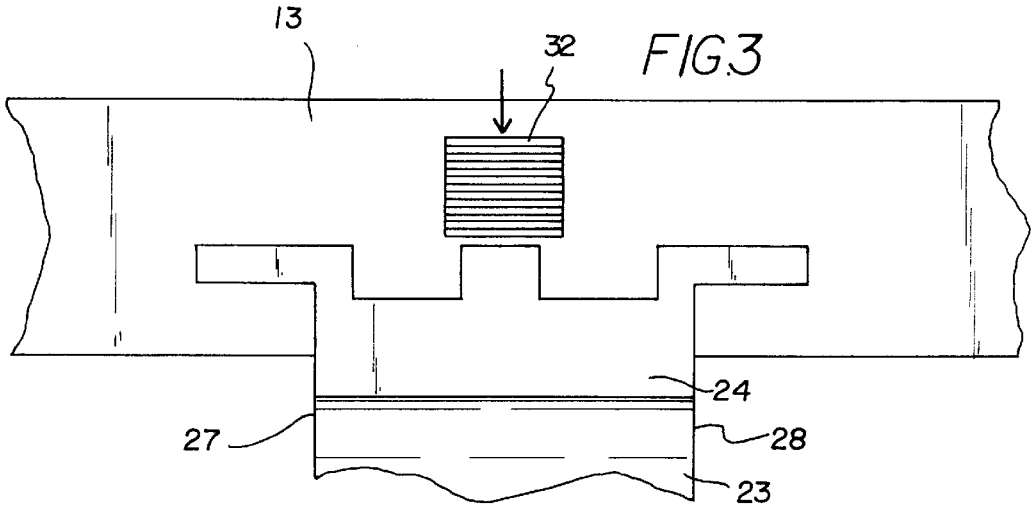
FIG. 3 is a schematic partial side view of the present invention taken from the circle 3 on FIG. 2.
Figure 4:
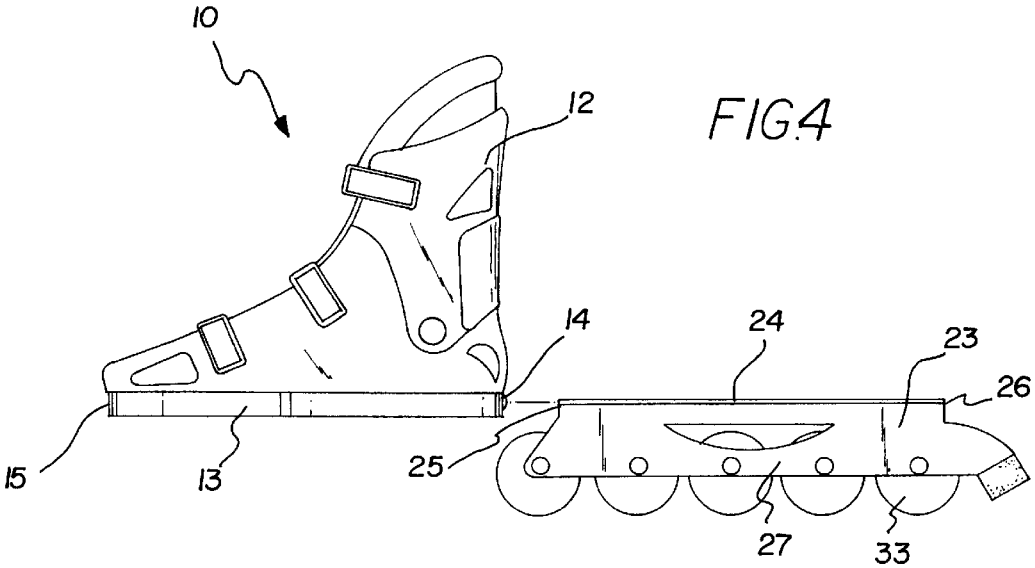
FIG. 4 is a schematic exploded side view of the present invention.
Figure 5:
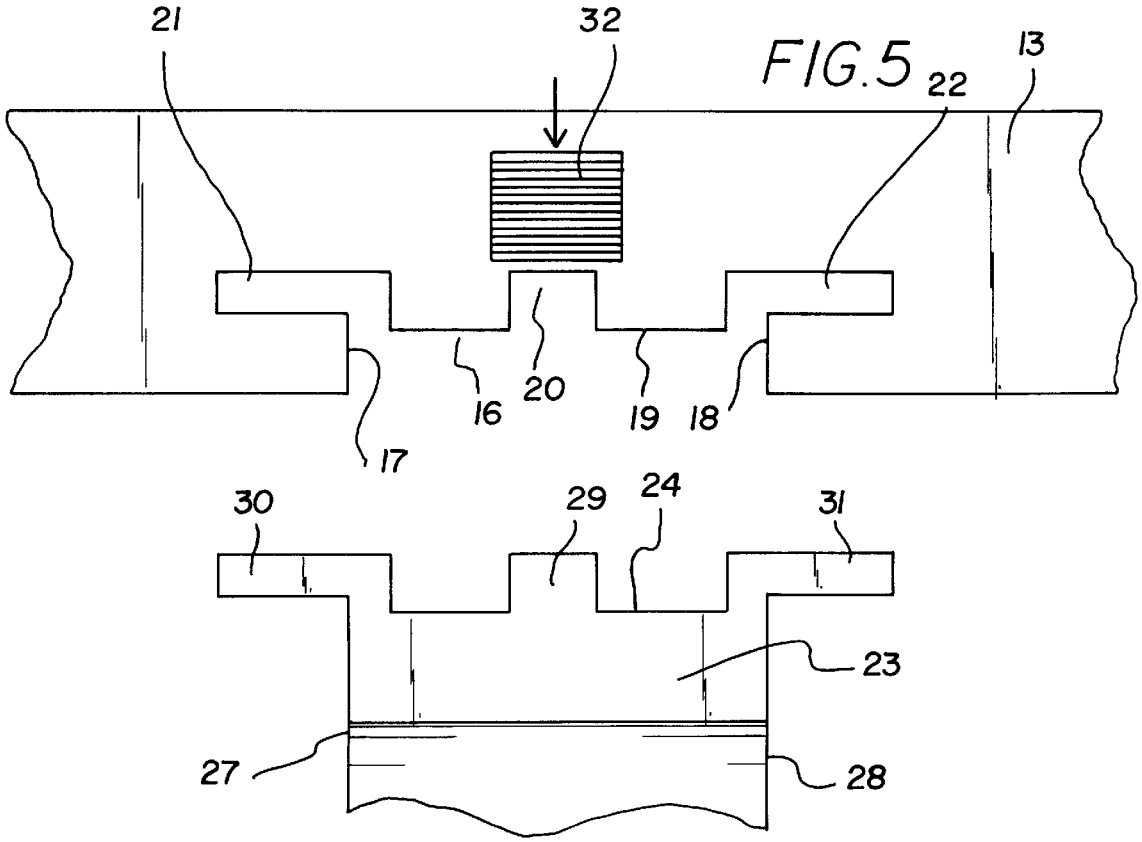
FIG. 5 is a schematic exploded side view of the present invention.

With reference now to the drawings, and in particular to FIGS. 1 through 5 thereof, a new inline skate assembly embodying the principles and concepts of the present invention and generally designated by the reference numeral 10 will be described.

As best illustrated in FIGS. 1 through 5, the inline skate assembly 10 generally comprises a boot portion 12 and a truck portion 23. The boot portion 12 has a sole 13, and heel and toe ends 14,15. The truck portion 23 has a top 24, first and second ends 25,26, a pair of sides 27,28, and a plurality of ground engaging wheels 33 rotatably mounted thereto. The sole 13 of the boot portion 12 has an elongate channel 16 therein. The length of the channel 16 is extended between the heel and toe ends 14,15 of the boot portion 12. The top 24 of the truck portion 23 is slidably insertable into the channel 16 of the sole 13 of the boot portion 12 to attach the truck portion 23 to the base portion 19.

In closer detail, the boot portion 12 has a sole 13, and heel and toe ends 14,15. The sole 13 of the boot portion 12 has an elongate channel 16 therein. The channel 16 has a length, a pair of spaced apart side portions 17,18 and a base portion 19 extending between the side portions 17,18 of the channel 16. The length of the channel 16 is extended between the heel and toe ends 14,15 of the boot portion 12. The channel 16 preferably has a generally rectangular cross section such that the side portions 17,18 of the channel 16 is generally parallel with one another and the base portion 19 of the channel 16 is generally perpendicular to the side portions 17,18 of the channel 16.

Preferably, the base portion 19 of the channel 16 has an elongate groove 20 extending into the sole 13 of the boot portion 12. The groove 20 preferably has a generally rectangular cross section and a length extending between the heel and toe ends 14,15 of the boot portion 12. The groove 20 is preferably positioned generally equidistant between the side portions 17,18 of the channel 16.

Also preferably, the base portion 19 of the channel 16 has a pair of spaced apart elongate slots 21,22 extending into the sole 13 of the boot portion 12. Each of the slots 21,22 has a length extending between the heel and toe ends 14,15 of the boot portion 12. One of the slots 21 is positioned adjacent one of the side portions 17 of the channel 16 and the other slot 22 is positioned adjacent the other side portion 18 of the channel 16. Each of the slots 21,22 has a width outwardly extending from the associated side portion of the channel 16. Preferably, the slots 21,22 lie in planes generally parallel to a plane the base portion 19 of the channel 16 lies in.

The truck portion 23 has a top 24, first and second ends 25,26, and a pair of sides extending between the ends of the truck portion 23. A plurality of ground engaging wheels 33 are rotatably mounted to the truck portion 23 to permit free rotation of the wheels 33. The top 24 of the truck portion 23 is slidably insertable into the channel 16 of the sole 13 of the boot portion 12 from either end of the boot portion 12 to attach the truck portion 23 to the base portion 19. The top 24 of the truck portion 23 preferably has an elongate ridge 29 upwardly extending therefrom. The ridge 29 preferably has a generally rectangular cross section and a length extending between the first and second ends 25,26 of the truck portion 23. The ridge 29 is preferably centrally positioned between the sides of the truck portion 23. The ridge 29 is slidably insertable into the groove of the base portion 19 of the channel 16 when the top 24 of the truck portion 23 is inserted into the channel 16 of the boot portion 12.

Even more preferably, the top 24 of the truck portion 23 has a pair of elongate flanges 30,31 extending therefrom. Each flange has a length extending between the first and second ends 25,26 of the truck portion 23. The width of one of the flanges 30 is outwardly extended from one of the sides 27 of the truck portion 23 while the width of the other flanges 31 is outwardly extended from the other side 28 of the truck portion 23. The flanges 30,31 are slidably insertable into the slots 21,22 of the channel 16 of the boot portion 12 when the top 24 of the truck portion 23 is inserted into the channel 16, one of the flanges 30,31 is inserted into one of the slots 21,22, another of the flanges 30,31 is inserted into another of the slots 21,22 to help securely hold the truck portion to the boot portion.

Ideally, a spring latch 32 is provided on the boot portion 12. Preferably, the latch 32 is located adjacent the heel end 14 of the boot portion 12. The latch 32 releasably holds the truck portion 23 to the boot portion 12 when the top 24 of the truck portion 23 is inserted into the channel 16 of the sole 13 of the boot portion 12.

Optionally, the truck portion 23 has a hole therethrough between the sides 27,28 of the truck portion for permitting extension of a flexible cord therethrough for carrying the truck portion 23 when detached from the boot portion 12. Preferably, the hole is located towards the second end of said truck portion As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inline skate assembly, comprising:

a boot portion having a sole, and heel and toe ends;

a truck portion having a top, first and second ends, a pair of sides, and a plurality of ground engaging wheels rotatably mounted thereto;

said sole of said boot portion having an elongate channel therein, said channel having a length, a pair of spaced apart side portions and a base portion extending between said side portions of said channel, said length of said channel being extended between said heel and toe ends of said boot portion;

said top of said truck portion being slidably insertable into said channel of said sole of said boot portion to attach said truck portion to said base portion; and a latch being provided on said boot portion, said latch releasably holding said truck portion to said boot portion when said top of said truck portion is inserted into said channel of said sole of said boot portion, said latch being movable downwardly into a position adjacent said second end of said truck portion when said truck portion has fully engaged said sole of said boot portion such that said top of said truck portion is blocked from moving out of said channel of said sole of said boot portion until said latch is moved upwardly into a position allowing movement of said truck portion from said channel of said sole of said boot portion.

2. The inline skate assembly of claim 1, wherein said side portions of said channel are generally parallel with one another, and said base portion of said channel is generally perpendicular to said side portions of said channel.

3. The inline skate assembly of claim 1, wherein said base portion of said channel having an elongate groove, said groove having a length extending between said heel and toe ends of said boot portion, wherein said top of said truck portion has an elongate ridge upwardly extending therefrom, said ridge having a length extending between said first and second ends of said truck portion, said ridge being slidably insertable into said groove.

4. The inline skate assembly of claim 3, wherein said groove is positioned generally equidistant between said side portions of said channel.

5. The inline skate assembly of claim 1, wherein said base portion of said channel having a pair of spaced apart elongate slots, each of said slots having a length extending between said heel and toe ends of said boot portion, wherein said top of said truck portion has a pair of elongate flanges, each flange having a length extending between said first and second ends of said truck portion, and wherein said flanges are slidably insertable into said slots of said channel of said boot portion.

6. The inline skate assembly of claim 5, wherein one of said slots is positioned adjacent one of said side portions of said channel, and another of said slots is positioned adjacent another of said side portions of said channel, wherein one of said flanges is outwardly extended from one of said sides of said truck portion, and wherein another of said flanges is outwardly extended from another of said sides of said truck portion.

7. The inline skate assembly of claim 1, wherein each of said slots has a width outwardly extending from the associated side portion of said channel.

8. The inline skate assembly of claim 1, wherein said slots lie in planes generally parallel to a plane said base portion of said channel lies in.

9. The inline skate assembly of claim 1, wherein said latch is located adjacent said heel end of said boot portion.

10. An inline skate assembly, comprising:

a boot portion having a sole, and heel and toe ends;

a truck portion having a top, first and second ends, a pair of sides, and a plurality of ground engaging wheels rotatably mounted thereto;

said sole of said boot portion having an elongate channel therein, said channel having a length, a pair of spaced apart side portions and a base portion extending between said side portions of said channel, said length of said channel being extended between said heel and toe ends of said boot portion, said channel having a generally rectangular cross section such that said side portions of said channel are generally parallel with one another, said base portion of said channel being generally perpendicular to said side portions of said channel;

said base portion of said channel having an elongate groove extending into said sole of said boot portion, said groove having a generally rectangular cross section and a length extending between said heel and toe ends of said boot portion, said groove being positioned generally equidistant between said side portions of said channel;

said base portion of said channel having a pair of spaced apart elongate slots extending into said sole of said boot portion, each of said slots having a length extending between said heel and toe ends of said boot portion, one of said slots being positioned adjacent one of said side portions of said channel, another of said slots being positioned adjacent another of said side portions of said channel, each of said slots having a width outwardly extending from the associated side portion of said channel, said slots lying in planes generally parallel to a plane said base portion of said channel lies in;

said top of said truck portion being slidably insertable into said channel of said sole of said boot portion to attach said truck portion to said base portion;

said top of said truck portion having a generally rectangular cross section and having an elongate ridge upwardly extending therefrom, said ridge having a length extending between said first and second ends of said truck portion, said ridge being centrally positioned between said sides of said truck portion, said ridge being slidably insertable into said groove of said base portion of said channel when said top of said truck is inserted into said channel of said boot portion;

said top of said truck portion having a pair of elongate flanges, each flange having a length extending between said first and second ends of said truck portion, one of said flanges being outwardly extended from one of said sides of said truck portion, another of said flanges being outwardly extended from another of said sides of said truck portion, said flanges being slidably insertable into said slots of said channel of said boot portion when said top of said truck portion is inserted into said channel, one of said flanges being inserted into one of said slots, another of said flanges being inserted into another of said slots; and a latch being provided on said boot portion, said latch being located adjacent said heel end of said boot portion, said latch releasably holding said truck portion to said boot portion when said top of said truck portion is inserted into said channel of said sole of said boot portion, said latch being movable downwardly into a position adjacent said second end of said truck portion when said truck portion has fully engaged said sole of said boot portion such that said top of said truck portion is blocked from moving out of said channel of said sole of said boot portion until said latch is moved upwardly into a position allowing movement of said truck portion from said channel of said sole of said boot portion.

* * * * *